United States Patent [19]

Miller

[11] 4,028,824

[45] June 14, 1977

[54] MAILING-PRICE LABEL

[75] Inventor: Harold R. Miller, Ferris, Tex.

[73] Assignee: Data Documents, Inc., Dallas, Tex.

[22] Filed: Oct. 18, 1976

[21] Appl. No.: 733,165

[52] U.S. Cl. ..... 40/2 R
[51] Int. Cl.[2] ..... A44C 3/00
[58] Field of Search ..... 283/18, 21; 40/2 R, 40/125 A, 312

[56] References Cited

UNITED STATES PATENTS

| | | | |
|---|---|---|---|
| 515,275 | 2/1894 | Bishoprick | 40/2 R X |
| 1,264,798 | 4/1918 | Hope | 40/2 R |
| 2,391,539 | 12/1945 | Avery | 40/2 R |
| 2,767,495 | 10/1956 | Harris | 40/2 R |
| 3,991,495 | 11/1976 | Wilson | 40/125 A X |

*Primary Examiner*—Russell R. Kinsey
*Assistant Examiner*—Wenceslao J. Contreras
*Attorney, Agent, or Firm*—Richards, Harris & Medlock

[57] ABSTRACT

A mailing-price tab label of two adjacent rectangular sections one of which is of width greater than the other as to extend beyond opposed edges of the other, and having an adhesive coated back surface. A peelable backing paper overlays and protects the adhesive coated back surface. The label is scored at the boundary of the two rectangular sections and the smaller of the two sections is scored to form a plurality of small severable rectangular labels. The backing paper is die cut for removal from the back of the larger rectangular section independently of removal from the small severable rectangular labels. And the label is foldable along the boundary between the two adjacent rectangular sections to form a mailing label carrying with it a plurality of small severable rectangular labels for application to items transported under direction of the mailing label.

6 Claims, 3 Drawing Figures

MAILING-PRICE LABEL

SUMMARY OF THE INVENTION

This invention relates to a mailing-price tag label, and more particularly to a mailing-price tag wherein the price tag portion remains attached to the mailing address portion.

BACKGROUND OF THE INVENTION

This invention relates to a mailing-price tag label for addressing a shipping carton of retail items and upon arrival at the retail outlet a plurality of severable price tags may be removed or reclaimed from the label and applied to the merchandise contained within the carton.

In the retail industry after the manufacturer produces a product it commonly is shipped to a wholesaler who in turn must ship to a retailer for distribution to a subsequent purchaser. The wholesaler on many orders includes preprinted price tags for the individual items contained within the shipping carton. Heretofore, these preprinted price tags have been packed inside the carton to insure that the correct price tags are put on the correct items once the shipment reaches the retail store. Such packed price tags were many times misplaced by the retailer thus necessitating the printing of new price tags. Also, in most cases it was necessary for the wholesaler to open and then to reseal the cartons of merchandise so that price tags could be "seeded" into the cartons with the merchandise.

The present invention comprises a label serving the dual function of providing an addressing label for the shipping cartons and in addition includes the price tags for the merchandise contained within the carton. A feature of the present invention is to provide a mailing-price tag label in a one piece construction. An additional feature of the present invention is to provide a one piece mailing price tag label that is printed with a shipping address and price marking in a single operation. Still another feature of the present invention is to provide a mailing-price tag label where the price tags remain with the address portion until used by a retailer.

In accordance with the preferred embodiment of the invention, a label with two rectangular sections, one being an address section of width greater than a price tag section and both sections having an adhesive backing, is to be folded and affixed to a shipping carton. The label is applied to the carton so that the address section is exposed and the price tags are concealed and protected beneath the address section. When the retailers receive the carton, the address section is ripped off to recover the price tags to be applied to the merchandise contained within the carton. A backing paper covers the adhesive backing of both sections that must be removed before the sections are used. The backing paper is die cut around the price tag section, and this die cut extends into the address section thus enabling the removal of the backing paper from the mailing address section independent of the backing paper protecting the adhesive backing of the price tag section.

BRIEF DESCRIPTION OF THE DRAWINGS

For a more complete understanding of the present invention and for further advantages thereof, reference may now be had to the following description taken in conjunction with the accompanying drawings.

Referring to the drawings.

DESCRIPTION OF THE PREFERRED EMBODIMENT

Figure 1:
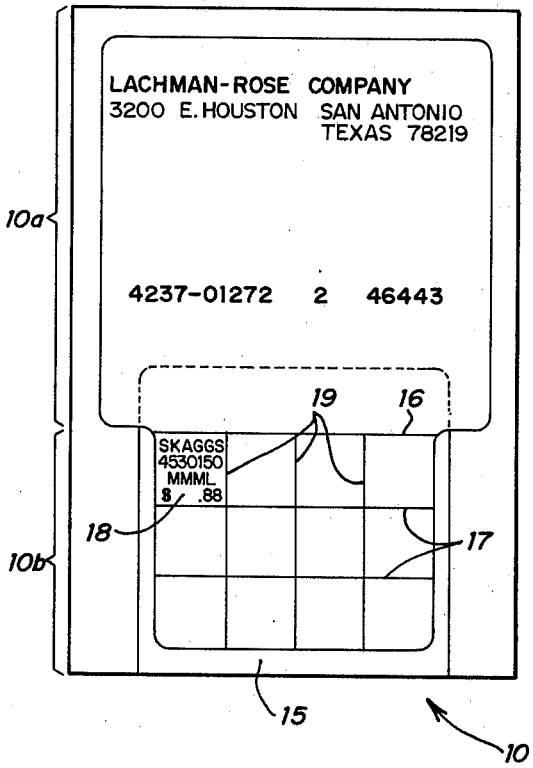
FIG. 1 is a front view of the present invention, showing a label and a backing paper.

Now referring to FIG. 1, the present invention pertains to a label 10 having two sections, an address section 10*a* and a price tag section 10*b*. Label 10 has an adhesive backing to enable it to be affixed to a shipping carton. The adhesive backing of label 10 is protected and preserved by peelable backing paper 15. Label 10 is scored at line 16 thereby forming a boundary between the address sections 10*a* and the price tag section 10*b*. As illustrated, the price tag section 10*b* is made up of twelve individual price tags 18 and is scored at lines 17 and at lines 19 to form the price tags. The number of price tags 18 on section 10*b* corresponds directly to the number of items contained within the shipping carton. Address section 10*a* has a width greater than that of price tag section 10*b*, such that when the label 10 is folded at line 16, section 10*a* extends beyond the opposing edges of 10*b* thereby enabling the label to be affixed to a shipping carton by means of the exposed adhesive surface of section 10*a*.

A manufacturer or wholesaler prints the address of a shipment on the address section 10*a* and at the same time also prints pricing information on each of the tags 18 of the price tag section 10*b*. The pricing information is necessarily associated with a particular item for which the mailing address has been prepared. Both the address sections 10*a* and the price tag section 10*b* remain as an integral unit until the tags 18 are to be affixed to an item by a retailer. By maintaining the tags 18 as an integral part of the mailing address section 10*a* a manufacturer or wholesaler is able to ship the same item to many retailers each of which may sell the item at a different unit price.

Figure 2:
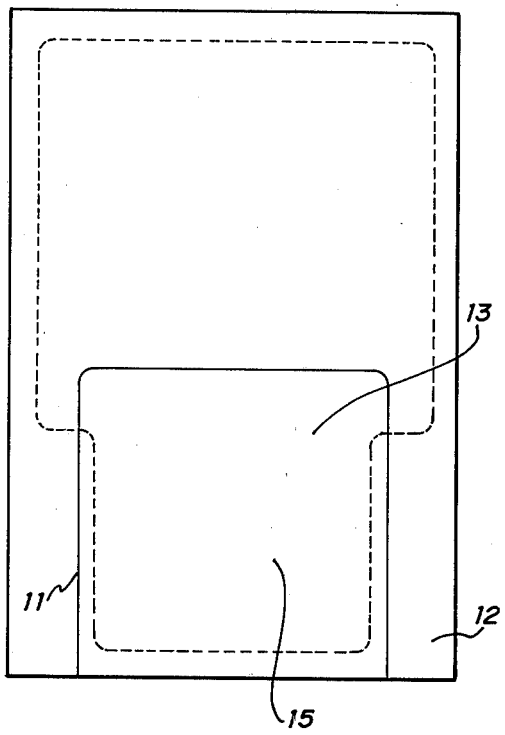
FIG. 2 is a back view illustrating the die cut outline of the backing paper.

Referring to FIG. 2, there is illustrated the backing paper 15 in which line 11 identifies the die cut in the backing paper thereby forming two sections, a tab section 13 and an outer section 12. The die cut extends to a depth of the thickness of the backing paper 15, but not into the address section 10*a* of the label 10. Thus, the address section 10*a* is a continuous surface, and from the front view as shown in FIG. 1, the die cut is not visible. To provide the advantages of the present invention, the die cut 11 outlines the tab section 13 such that the edges thereof extend beyond the opposed edges of the price tab section 10*b*. This is illustrated by the dotted outline of the price tag section 10*b* in FIG. 2 and also by the line 11 of FIG. 1. Also, the die cut along the line 11 extends the tab section 13 to partially cover the address section 10*a*.

With the die cut pattern of the backing paper 15, when the address section 10*a* is removed the adhesive backing on this section is exposed. However, the backing paper 15 separates at the line 11 and the tab section 13 remains adhered to the back of the price tag 10*b* by the extension of the die cut upwards into the address section 10*a*.

Figure 3:
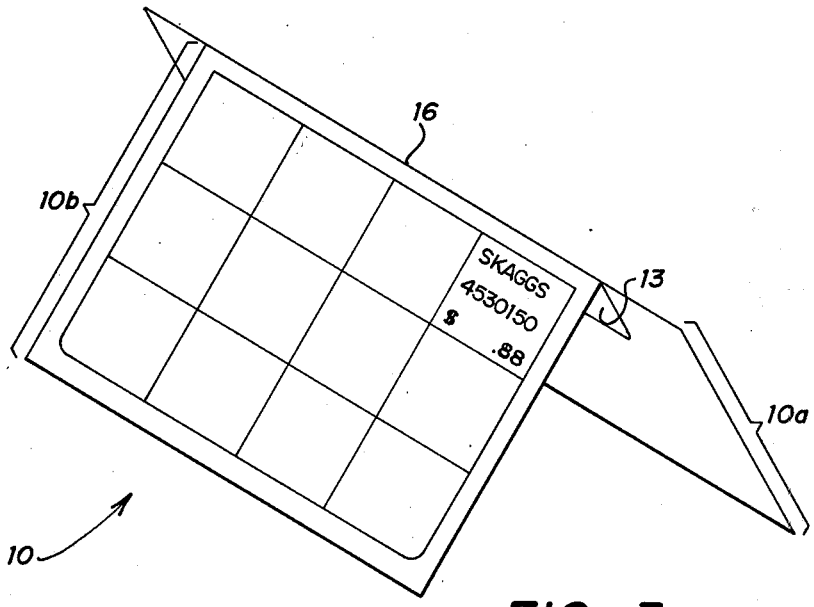
FIG. 3 is a perspective view showing the address section of the backing paper removed and the label being folded for attachment to the shipping carton.

Referring to FIG. 3, in use the label 10 is folded at the line 16 such that the tab section 13 adheres to the adhesive backing of address section 10*a*. A U-shaped area of the adhesive backing on the address section 10*a* remains exposed to affix the label 10 to a shipping carton. The label 10 is then affixed to a shipping carton by the exposed areas of the adhesive backing of section 10*a*, and price tag section 10*b* is concealed and protected beneath the section 10*a*.

While only one embodiment of the invention, together with modifications thereof, has been described in detail herein and shown in the accompanying drawings, it will be evident that various further modifications are possible without departing from the scope of the invention.

What is claimed is:

1. A mailing-price tag label which comprises:

a blank of two adjacent substantially rectangular areas one of which is of width greater than the second so as to extend beyond opposed edges of the second area, said blank having an adhesive coated back surface, a peelable backing paper overlaying and protecting said adhesive coated back surface, and said backing paper being cut into two sections and with one section overlaying the second area of the blank and extending into the section overlaying the first area for removal from the back paper from the first area independently of removal from said first area.

2. A mailing-price tag label as set forth in claim 1 wherein said blank is scored at the boundary of said two sections and with the smaller of the two sections being further scored to form a plurality of small severable rectangular labels.

3. A mailing-price tag label as set forth in claim 2 wherein said blank is folded along a boundary between said two adjacent sections to form a mailing label concealed within the plurality of small severable rectangular labels for application to the items transported under direction of the mailing label.

4. A mailing-price tag label as set forth in claim 1 wherein the one section of said backing paper extends beyond the opposed edges of the second area.

5. A mailing-price tag label as set forth in claim 1 wherein said backing paper is die cut to a depth extending to the adhesive coated back surface of said blank.

6. A mailing-price tag label as set forth in claim 1 wherein the one section of said backing paper overlaying the second area is substantially rectangular in shape.

* * * * *